US012276195B2

(12) United States Patent
Bellingham

(10) Patent No.: US 12,276,195 B2
(45) Date of Patent: Apr. 15, 2025

(54) ROCK BOLT ASSEMBLY HAVING AN INDICATOR

(71) Applicant: ROCBOLT TECHNOLOGIES (PTY) LTD., Germiston (ZA)

(72) Inventor: Werner Bellingham, Germiston (ZA)

(73) Assignee: ROCBOLT TECHNOLOGIES (PTY) LTD., Germiston (ZA)

( * ) Notice: Subject to any disclaimer, the term of this patent is extended or adjusted under 35 U.S.C. 154(b) by 88 days.

(21) Appl. No.: 18/277,919

(22) PCT Filed: Feb. 18, 2022

(86) PCT No.: PCT/IB2022/051454
§ 371 (c)(1),
(2) Date: Aug. 18, 2023

(87) PCT Pub. No.: WO2022/175879
PCT Pub. Date: Aug. 25, 2022

(65) Prior Publication Data

US 2024/0125233 A1 Apr. 18, 2024

(30) Foreign Application Priority Data

Feb. 19, 2021 (ZA) ..... 202101128

(51) Int. Cl.
*E21D 21/00* (2006.01)
*E21D 21/02* (2006.01)

(52) U.S. Cl.
CPC ..... *E21D 21/02* (2013.01); *E21D 21/0046* (2013.01)

(58) Field of Classification Search
CPC ... E21D 21/00; E21D 21/0026; E21D 21/008; E21D 21/0093; E21D 21/0046; E21D 21/002
See application file for complete search history.

(56) References Cited

U.S. PATENT DOCUMENTS 4,632,352 A * 12/1986 Stoll ..... G01D 11/30 248/316.6
10,370,969 B2 8/2019 Gustafsson
(Continued)

FOREIGN PATENT DOCUMENTS

CN 108589723 A 9/2018
CN 111828069 A 10/2020
SE 536834 A1 2/2012

*Primary Examiner* — Benjamin F Fiorello
(74) *Attorney, Agent, or Firm* — Corinne R. Gorski

(57) ABSTRACT

A rock bolt assembly provides an indication of a coupling. The rock bolt assembly includes two shaft sections, namely inner and outer shaft sections. A coupler is configured to couple the two shaft sections together at proximate ends. An electrical conductor is insulated from the outer shaft section and extends from the dead end of the outer shaft section to the head at the live end of the outer shaft section. An electrical contact arrangement is provided at the dead end of the outer shaft section, configured to electrically interconnect the outer shaft section and the conductor when the inner and outer shaft sections are coupled. Electrical terminals are provided at the head and connected respectively to the outer shaft section and to the conductor, the electrical terminals being electrically interconnected or continuous when the outer shaft section and the conductor are electrically interconnected.

16 Claims, 3 Drawing Sheets

(56) References Cited

U.S. PATENT DOCUMENTS

| | | | | |
|---|---|---|---|---|
| 2005/0011265 | A1* | 1/2005 | Brink | E21D 20/02 73/588 |
| 2005/0231377 | A1* | 10/2005 | Sunderman | E21D 21/004 340/665 |
| 2016/0326873 | A1 | 11/2016 | Skogseth et al. | |
| 2018/0067003 | A1* | 3/2018 | Michiwaki | G01L 5/0004 |
| 2019/0169987 | A1 | 6/2019 | Zhang et al. | |
| 2019/0203599 | A1* | 7/2019 | Sun | G01N 29/07 |
| 2020/0049184 | A1 | 2/2020 | Horn et al. | |
| 2022/0136389 | A1* | 5/2022 | Feiel | E21D 21/02 73/788 |

* cited by examiner

ROCK BOLT ASSEMBLY HAVING AN INDICATOR

RELATED APPLICATION DATA

This application is a § 371 National Stage Application of PCT International Application No. PCT/IB2022/051454 filed Feb. 18, 2022 claiming priority to EP 2021/01128 filed Feb. 19, 2021.

FIELD OF INVENTION

This invention relates broadly to wall bolts for mines or construction and specifically to a rock bolt assembly having an indicator.

BACKGROUND OF INVENTION

Rock bolts (or large wall bolts) are commonly used in mining and sometimes in rock-based construction. Such rock bolts include a head or thread and a shank with or without an engagement formation, to engage sides of a hole within which the rock bolt is inserted. For reference, an end of the rock bolt with the head/thread or nut, which remains outside the hole when installed, is referred to as the live end and the opposite end, which is inserted into the hole, is referred to as the dead end.

In some installations, the bolt actually comprises two bolt sections or shanks joined end-to-end by means of a coupling; this may be considered a compound bolt. Opposed ends of the bolt sections are typically threaded, and the coupling is hollow with an internal thread. This may be useful where headroom is limited, and a single bolt will be too long to have sufficient space to be inserted into the hole. Instead, the hole may be deeper than usual and require two bolt sections to be joined together to be long enough.

The bolt sections are often only coupled together when they, or at least the first shank, are in the hole. The coupling is not visible or observable once inside the hole. This leads to a difficulty to ensure that the coupling is complete or sufficient, and that both sections of the compound bolt have been installed. The outer section (at the live end) may be rotated, in the belief that it has engaged the coupling properly, until it cannot be rotated further, in the belief that it has fully engaged the coupling.

The Applicant desires a rock bolt assembly with an indication function to indicate when the sections have been coupled together.

SUMMARY OF INVENTION

Accordingly, the invention provides a rock bolt assembly which includes:

- two shaft sections, namely an inner shaft section which is intended to be at a dead end of the rock bolt assembly and an outer shaft section having a head at a live end which is intended to be at the live end of the rock bolt assembly, the outer shaft section being of an electrically conductive material;
- a coupler configured to couple the two shaft sections together at proximate ends, namely a dead end of the outer shaft section and a live end of the inner shaft section;
- an electrical conductor insulated from the outer shaft section and extending from the dead end of the outer shaft section to the head at the live end of the outer shaft section;

- an electrical contact arrangement at the dead end of the outer shaft section, the electrical contact arrangement configured to electrically interconnect the outer shaft section and the conductor when the inner and outer shaft sections are coupled; and
- electrical terminals provided at the head and connected respectively to the outer shaft section and to the conductor, the electrical terminals being electrically interconnected or continuous when the outer shaft section, the inner shaft section and the conductor are electrically interconnected.

One or both of the shaft sections may be of ferrous metal, e.g., steel.

One or both shafts may include a coating, covering, or sleeve. The outer shaft section specifically may include the coating, covering, or sleeve. The outer shaft section may include a PET (or other polymer) coating. The coating, covering, or sleeve may be around the outer shaft section and the electrical conductor. The coating, covering, or sleeve may serve to locate or hold the electrical conductor in place alongside the outer shaft section during installation.

The electrical contact arrangement may include two exposed electrical contacts, one connected to the outer shaft section and the other connected to the conductor. Interconnecting, or shorting out, the exposed electrical contacts may therefore interconnect the outer shaft section and the conductor. The exposed electrical contacts may be interconnected by the inner shaft section and/or by the coupler itself.

In a more basic embodiment of the rock bolt assembly, named a passive rock bolt assembly, the electrical terminals may merely be provided on the head without any device connected thereto. They may be provided such that they are exposed or accessible for a device to be connected, at least temporarily, thereto. The device may be a continuity measuring device, configured to measure or display whether or not the electrical contact arrangement has interconnected the outer shaft section, the inner shaft section and the conductor, thus indicating whether or not the rock bolt assembly is properly coupled together.

In a more developed embodiment, named an active rock bolt assembly, the rock bolt assembly may include a device, e.g., a continuity measuring device, coupled or attached thereto in the region of the head. The device may be electronically connected to the electrical terminals. The device may be, or may include, a continuity indicator. The device may provide an indication (e.g., an illuminated light) to indicate that the two shaft sections are properly coupled.

By way of further development, the indication by the continuity measuring device that two shaft sections are properly coupled is a first indication, the rock bolt assembly may further include:

- a frangible or deformable element configured to break or deform at a predefined load; and
- secondary contacts spaced apart on the frangible or deformable element.

The continuity measuring device (functioning as a second continuity indicator) may further be configured to provide a second indication to indicate whether the secondary contacts have made contact, thereby indicating that the frangible or deformable element has broken or deformed, and that the predefined load has been reached or exceeded.

The second continuity indicator may also provide a visual indication of continuity. The device may include two different coloured lights (e.g., LEDs) for indicating (1) that the two shaft sections are coupled and (2) that the predefined load has been reached. The lights may be green and blue (or other desired colour combination).

The frangible or deformable element may be in the form of an annulus or ring provided around the outer shaft section adjacent the head. The frangible element may be of hard plastic or a section of a PCB (Printed Circuit Board), or ferrous steel or aluminium, optionally that has an insulating coating.

The device may define a channel or aperture for accommodating the outer shaft section so that the device can be mounted onto the outer shaft section adjacent the head. The device may include a protective housing, e.g., made from a plastic material.

The device may include a power source like a battery for powering one or both continuity indicators.

BRIEF DESCRIPTION OF DRAWINGS

The invention will now be further described, by way of example, with reference to the accompanying diagrammatic drawings.

In the drawings.

DETAILED DESCRIPTION OF EXAMPLE EMBODIMENT

The following description of an example embodiment of the invention is provided as an enabling teaching of the invention. Those skilled in the relevant art will recognise that changes can be made to the example embodiment described, while still attaining the beneficial results of the present invention. It will also be apparent that some of the desired benefits of the present invention can be attained by selecting some of the features of the example embodiment without utilising other features. Accordingly, those skilled in the art will recognise that modifications and adaptations to the example embodiment are possible and can even be desirable in certain circumstances and are a part of the present invention. Thus, the following description of the example embodiment is provided as illustrative of the principles of the present invention and not a limitation thereof.

Figure 1:
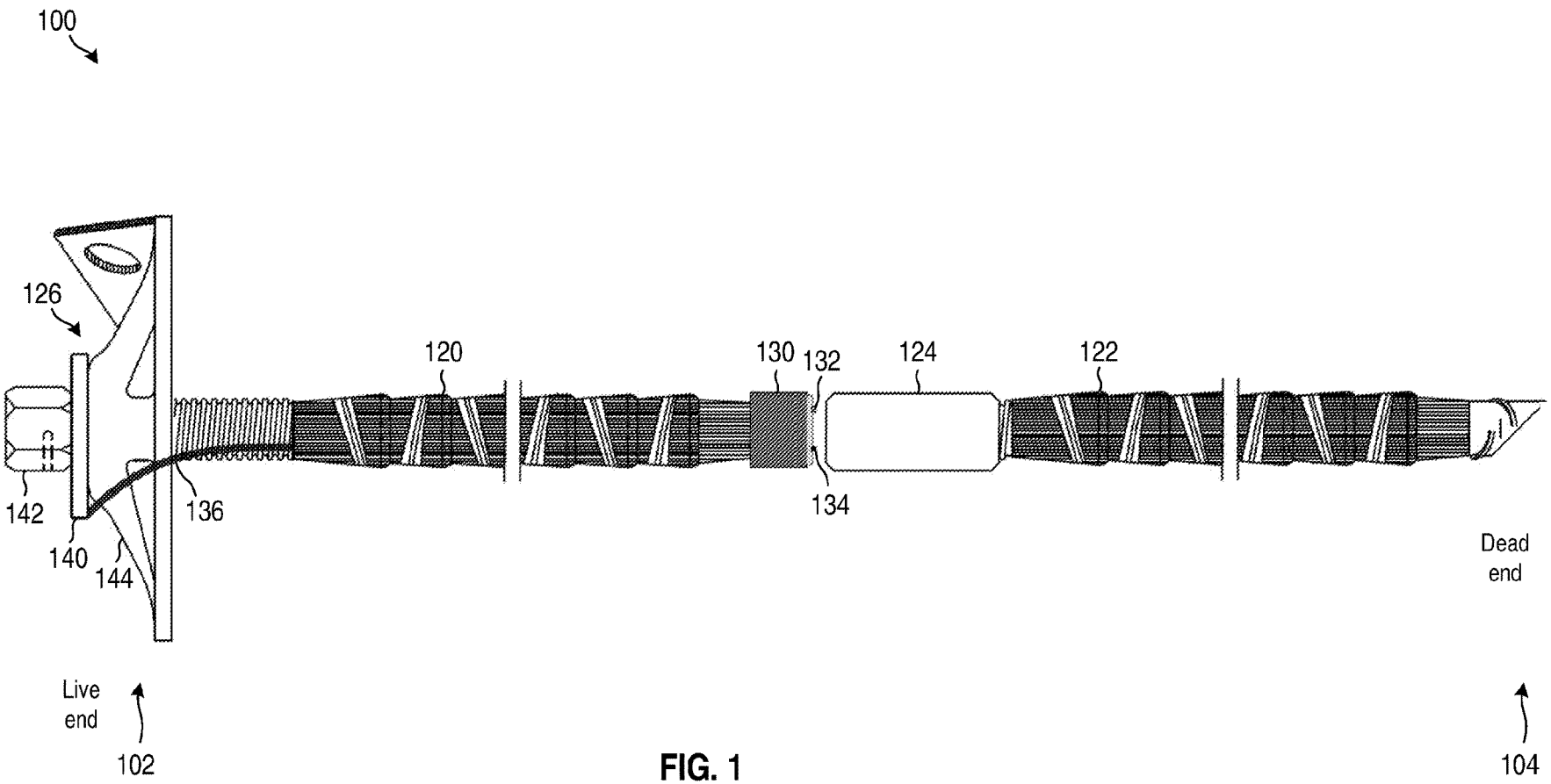
FIG. 1 shows a schematic side view of a "passive" rock bolt assembly, in accordance with the invention.

FIG. 1 illustrates a passive embodiment of a rock bolt assembly 100 in accordance with the invention. As reference points, the rock bolt assembly 100 has a live end 102 which, in use, will project out of a hole drilled in a rock wall and has structures which will abut against the rock wall, and a dead end 104 which, in use, is inserted as far as it will go into the hole in the rock wall. It will be appreciated that, when inserted, much of the rock bolt assembly 100 towards the dead end 104 will not normally be visible or observable.

The rock bolt assembly 100 may be thought of as a compound bolt and includes components which may be largely conventional, namely an outer shaft section 120 (towards the live end 102), an inner shaft section 122 (towards the dead end 104), and a coupler 124. The shaft sections 120, 122 may include textured or gripping surfaces as desired. Opposed ends of the shaft sections 120, 122 in the middle (at the coupler 124) include a male thread while the coupler 124 is largely hollow and defines an internal female thread. The rock bolt assembly 100 includes a head 126 which may include various nuts or washers (see below) depending on its intended application.

The coupler 124 is configured to receive the threaded ends of the shaft sections 120, 122 and join them together in situ, that is, inside the hole in the rock wall. This is useful, for the reason mentioned above in the BACKGROUND but also gives rise to those problems mentioned.

Accordingly, the rock bolt assembly 100 includes an electrical conductor 136 extending from a dead end of the outer shaft 120, along the outer shaft section 120, and towards the head 126. The conductor 136 is insulated from the outer shaft section 120. The shaft sections 120, 122 are made of steel, to be strong and support a load, as is their purpose. The coupler 124 is also made of steel.

An electrical contact arrangement 130, 132, 134 is provided at the dead end of the outer shaft section 120. A plastic (insulating) collar or disc 130 mounted to an end of the outer shaft section 120 supports two exposed electrical contacts 132, 134, with a first contact 132 being electrically connected to the outer shaft section 120 and a second contact 134 being electrically connected to the conductor 136.

Interconnecting, or shorting out, the exposed electrical contacts 132, 134 therefore interconnects the outer shaft section 130 and the conductor 136. More specifically, this interconnection is configured to occur when the inner and outer shaft sections 120, 122 are coupled. A flat metal (conductive) structure pressed across the contacts 132, 134 would do this. Therefore, this may be realised by a metallic wall of the coupler 124 shorting out the contacts 132, 134 or by an end of the inner shaft section 122 doing so. Either way, this should only occur when the shaft sections 120, 122 are sufficiently interconnected and coupled by the coupler 124.

At the live end 102, electrical terminals are provided. The head 126 may include a large domed washer 144 and a nut 142 but the configuration of these may vary depending on an application of the rock bolt assembly 100. The nut 142 (being of steel) is threadingly mounted to, and therefore electrically connected to, the outer shaft section 120. The nut thus serves as a first electrical terminal. A plastic support disc 140 is provided, sandwiched between the nut 142 and the washer 144. An exposed end of the conductor 136 is fixed to the plastic disc 140 and this exposed end serves as the second electrical terminal.

Although not separately illustrated, the conductor 136 is insulated with, e.g., a plastic sleeve, and a PET coating is applied to the combination of the outer shaft section 120 and the insulated conductor 136 to bind them securely together.

It may be noted that there is only one external conductor 136 provided and the outer shaft section itself 120 acts as a second conductor. In a different embodiment (not illustrated), the outer shaft section 120 may be configured not to be a conductor and two external wires may be provided to serve as respective conductors.

Figure 2:
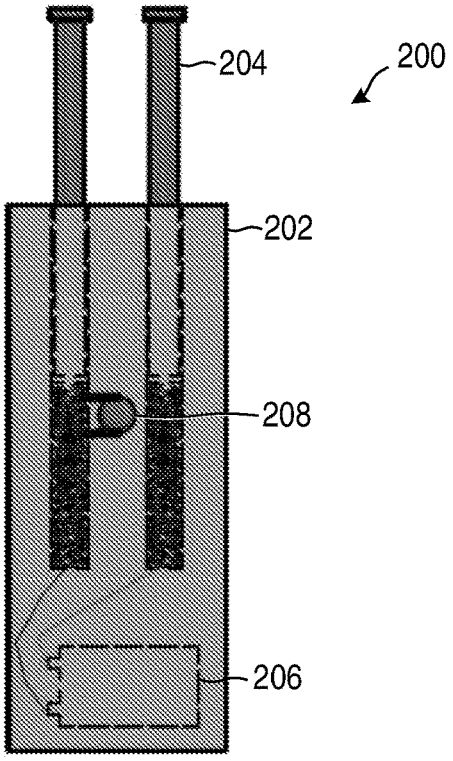
FIG. 2 shows a sectional view of a continuity testing device for use with the rock bolt assembly of FIG. 1.
Figure 3:
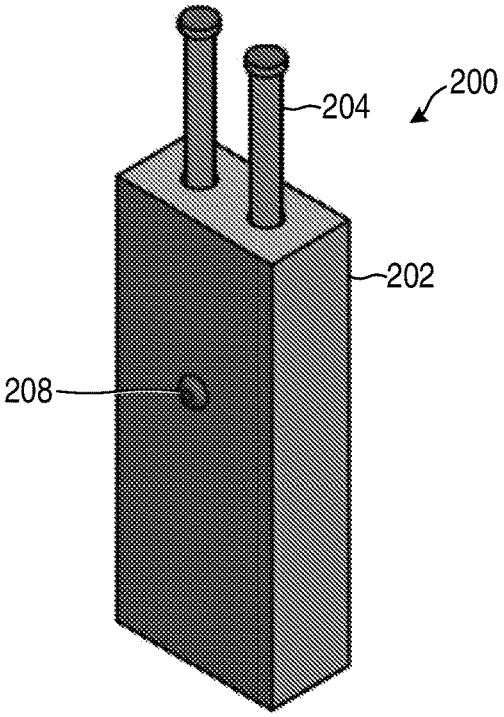
FIG. 3 shows a three-dimensional view of the continuity testing device of FIG. 2.

FIGS. 2-3 illustrate a continuity testing device 200 for indicating whether or not the exposed electrical contacts 132, 134 of the rock bolt assembly 100 have been shorted. The device 200 comprises a plastic housing 202 with two electrical prongs 204 projecting outwardly therefrom. Internally, the device 200 has a battery 206 to power a light 208 when a circuit is completed. As spacing between the prongs 204 is designed to be matched, or at least similar, to a spacing between the nut 142 and the exposed end of the conductor 136 on the disc 140. Instead of the specific continuity testing device 200, a generic multimeter with a continuity test mode could be used.

In use, a user (who could be an installer doing a rock bolt installation or a foreman checking on a prior installation)

merely touches the prongs 204 of the device 200 to the electrical terminals, i.e., the nut 142 and the exposed end of the conductor 136 on the disc 140. If the light 208 illuminates, this means that the exposed contacts 132, 134 have been shorted or interconnected, which indicates that the two shaft sections 120, 122 have been coupled satisfactorily by means of the coupler 124.

Figure 4:
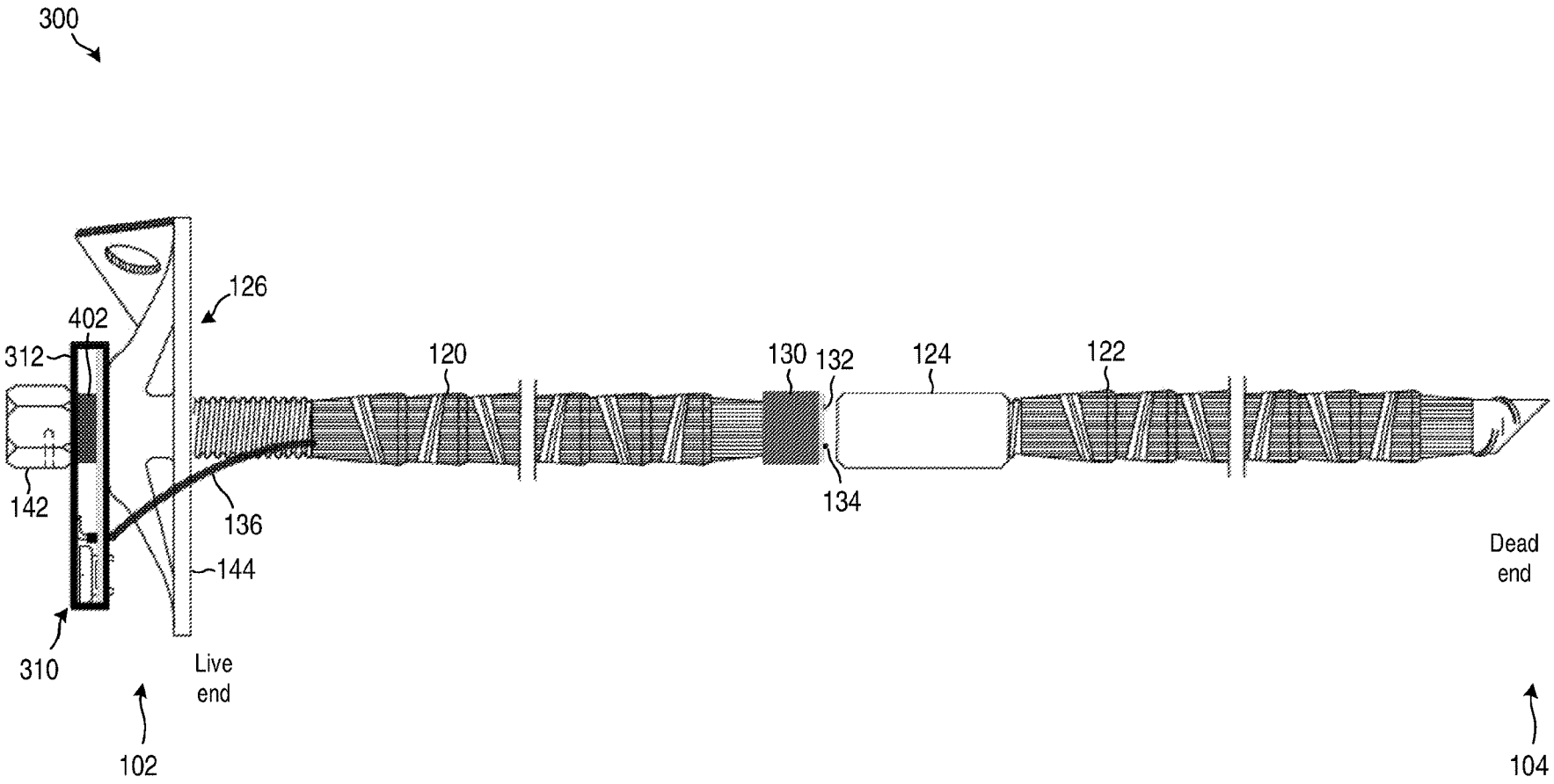
FIG. 4 shows a schematic side view of an "active" rock bolt assembly, in accordance with the invention.

FIG. 4 illustrates an active embodiment of a rock bolt assembly 300 in accordance with the invention. The same reference numerals as those in FIG. 1 refer to the same or similar parts. The main difference between the rock bolt assemblies 100, 300 is that the active rock bolt assembly 300 has a continuity measuring device 310 integrated therewith. The continuity measuring device 310 has a modified housing 312 which includes an aperture to accommodate part of the outer shaft section 120 so that the continuity measuring device 310 can be mounted to the head 126 of the rock bolt assembly 300.

The rock bolt assembly 300 may include a second indicating function. The rock bolt assembly 300 may include a frangible element (e.g., disc or sleeve 402) which is configured to fracture at a predetermined load. Once the frangible element 402 fractures, it may allow two secondary contacts (e.g., one provided inside the device 310 and the other provided by the nut 142) to make contact. This may cause a secondary light (not illustrated) to illuminate.

In such case, when installing the rock bolt assembly 300, a miner may couple the outer shaft section 120 by rotating the nut 142 until the indicator light 208 (provided on the continuity measuring device 310) illuminates, indicating that the shafts sections 120, 122 are coupled. He then continues rotating and tightening the nut 142 until the secondary light illuminates, indicating that the predefined load tension has been reached. Failure of either of the two lights to illuminate may indicate a problem (e.g., lack of coupling or lack of pre-tension).

The Applicant believes that the invention as exemplified is advantageous in that it provides a simple yet effective way to indicate whether or not a compound rock bolt has been sufficiently coupled. While some modifications to parts of the rock bolt are required, this can be done fairly cost effectively without hampering the support/bolting functionality of the rock bolt itself. This should increase the effectiveness and safety of installed compound rock bolts, by ensuring correct coupling the first time. Further, using some of the components already provided in the indicator device 310, a load indication can also be provided.

The invention claimed is:

1. A rock bolt assembly comprising:

two shaft sections, including an inner shaft section arranged at a dead end of the rock bolt assembly and an outer shaft section having a head at a live end arranged at the live end of the rock bolt assembly, the outer shaft section being made of an electrically conductive material;

a coupler configured to couple the two shaft sections together at proximate ends, a dead end of the outer shaft section and a live end of the inner shaft section;

an electrical conductor insulated from the outer shaft section and extending from the dead end of the outer shaft section to the head at the live end of the outer shaft section;

an electrical contact arrangement disposed at the dead end of the outer shaft section, the electrical contact arrangement configured to electrically interconnect the outer shaft section and the conductor when the inner and outer shaft sections are coupled; and electrical terminals provided at the head and connected respectively to the outer shaft section and to the conductor, the electrical terminals being interconnected when the outer shaft section and the conductor are electrically interconnected.

2. The rock bolt assembly as claimed in claim 1, wherein one or both two shaft sections include a coating, covering, or sleeve.

3. The rock bolt assembly as claimed in claim 2, wherein the outer shaft section includes the coating, covering, or sleeve, and the coating, covering, or sleeve is provided around both the outer shaft section and the electrical conductor, thereby serving to locate or hold the electrical conductor in place alongside the outer shaft section during installation.

4. The rock bolt assembly as claimed in claim 1, wherein the electrical contact arrangement includes two exposed electrical contacts, one electrical contact connected to the outer shaft section and another electrical contact connected to the conductor, and interconnecting, or shorting out, the exposed electrical contacts interconnects the outer shaft section and the conductor.

5. The rock bolt assembly as claimed in claim 4, wherein the exposed electrical contacts are configured to be interconnected by the inner shaft section and/or by the coupler itself.

6. The rock bolt assembly as claimed in claim 1, wherein the electrical terminals are merely provided on the head without any device connected thereto such that they are exposed or accessible for a separate continuity measuring device to be connected, at least temporarily, thereto.

7. The rock bolt assembly as claimed in claim 1, further comprising a continuity measuring device coupled or attached thereto in a region of the head, the continuity measuring device being electronically connected to the electrical terminals.

8. The rock bolt assembly as claimed in claim 7, wherein the continuity measuring device is configured to indicate by way of a light emitter or illuminated display whether the electrical terminals are electrically continuous, thereby to provide an indication whether the two shaft sections are properly coupled.

9. The rock bolt assembly as claimed in claim 8, wherein the indication by the continuity measuring device that two shaft sections are properly coupled is a first indication, the rock bolt assembly further comprising:

a frangible or deformable element configured to break or deform at a predefined load; and secondary contacts spaced apart on the frangible or deformable element, wherein the continuity measuring device is further configured to provide a second indication to indicate whether the secondary contacts have made contact, thereby indicating that the frangible or deformable element has broken or deformed, and that the predefined load has been reached or exceeded.

10. The rock bolt assembly as claimed in claim 9, wherein the continuity measuring device includes two visual indicators, a first visual indicator arranged to provide the first indication and a second visual indicator arranged to provide the second indication.

11. The rock bolt assembly as claimed in claim 10, wherein the two visual indicators are different coloured light emitters.

12. The rock bolt assembly as claimed in claim 10, wherein the frangible or deformable element is an annulus or ring provided around the outer shaft section adjacent the head.

13. The rock bolt assembly as claimed in claim 12, wherein the frangible or deformable element is of hard plastic or a section of a PCB (Printed Circuit Board), or ferrous steel, or aluminium which may have an insulating coating.

14. The rock bolt assembly as claimed in claim 13, wherein the frangible or deformable element is of ferrous steel or aluminium and has an insulating coating.

15. The rock bolt assembly as claimed in claim 9, wherein the continuity measuring device defines a channel or aperture for accommodating the outer shaft section so that the continuity measuring device can be mounted onto the outer shaft section adjacent the head.

16. The rock bolt assembly as claimed in claim 9, wherein the continuity measuring device is self-contained and includes a battery for powering the light emitter or emitters.

* * * * *